US007896758B2

(12) United States Patent
Luby et al.

(10) Patent No.: US 7,896,758 B2
(45) Date of Patent: Mar. 1, 2011

(54) SOCCER TRAINER

(76) Inventors: Timothy J. Luby, Port Orange, FL (US); Michael J. Militti, Port Orange, FL (US)

( * ) Notice: Subject to any disclaimer, the term of this patent is extended or adjusted under 35 U.S.C. 154(b) by 238 days.

(21) Appl. No.: 12/139,130

(22) Filed: Jun. 13, 2008

(65) Prior Publication Data

US 2009/0312124 A1 Dec. 17, 2009

(51) Int. Cl.
*A63B 69/00* (2006.01)

(52) U.S. Cl. ..... 473/446

(58) Field of Classification Search ..... 473/446, 473/423, 426, 420, 422; 472/92; 5/420
See application file for complete search history.

(56) References Cited

U.S. PATENT DOCUMENTS

| | | | | | |
|---|---|---|---|---|---|
| 638,220 | A * | 12/1899 | De Wolf | 273/398 |
| 3,227,450 | A * | 1/1966 | Pruitt | 473/426 |
| 3,668,781 | A * | 6/1972 | Teter | 33/1 H |
| 4,160,324 | A * | 7/1979 | Dunn | 33/759 |
| 4,880,243 | A * | 11/1989 | Raub | 473/490 |
| 5,107,595 | A * | 4/1992 | Stay et al. | 33/1 G |
| 5,427,383 | A * | 6/1995 | Viens | 473/490 |
| 5,465,958 | A * | 11/1995 | Brun | 473/426 |
| 6,802,788 | B1 * | 10/2004 | Moushi et al. | 473/426 |
| 6,893,365 | B2 * | 5/2005 | Rathbun et al. | 473/500 |
| 7,371,194 | B2 * | 5/2008 | Babiak et al. | 473/468 |
| 2008/0015057 | A1 * | 1/2008 | Hayes | 473/420 |

* cited by examiner

*Primary Examiner* — Gene Kim
*Assistant Examiner* — M Chambers

(57) ABSTRACT

The present invention is a soccer trainer [1000] which allows players to practice kicking a soccer ball toward a target and/or positioning themselves inside of the goal. It employs a flexible kick pad [1100] indicating where to kick a soccer ball from, and at least two guidelines [1370] from either side of the kick pad [1100] to the sides of the goal [10]. The guidelines [1370] are used to identify the maximum angle to kick the ball which will result in a goal. The guidelines [1370] can be retracted onto a reel [1350] inside base mechanism [1300] for storage. In order to practice kicking past players by curving the ball around defenders, simulated blockers [1320] are used. These simulate blockers [1320] attached to different attachment points [1410] on base mechanism [1300] represent various sized players at various distances.

17 Claims, 8 Drawing Sheets

SOCCER TRAINER

BACKGROUND OF THE INVENTION

1. Field of the Invention

The present invention relates to a novel training device which instructs a soccer player to accurately aim and kick a soccer ball and to defend a soccer goal.

2. Discussion of Related Art

Soccer is a sport played on a field with boundaries and consists of the following elements: two opposing teams, a soccer ball, goals located on either end of the field, and is governed by the laws of the game. A soccer team is comprised of not less than seven and not more than eleven players, one of whom is the goalkeeper or "goalie." The purpose of the goalie is to guard the goal and prevent the opposing team from scoring.

The goal is located at either end of the field and is comprised of two upright posts located 8 yards apart, called the goal posts and a horizontal cross bar connecting the tops of the goal posts at a distance 8 feet from the ground.

The failure of a player to properly position himself or herself in the goal reduces their chances of blocking a shot kicked toward the goal, referred to a shot "on goal".

Other players attempt shots on goal, in which a shot on goal is any attempt to score a goal according to the rules of the game. A goal is scored when the soccer ball passes into the goal.

A common problem an opposing player faces is to achieve accurate aim, prior to a shot on goal, in relation to the goal and the other players on the field. The failure of the player to optimally position him or herself in relation to the goal reduces the chances that the player will score.

Due to the positioning of opposing players on the field, there may be no straight line into the goal. An experienced soccer player would have to curve the ball around players or objects to get it into the goal.

Prior art devices rely on the existence of a "straight shot" to the goal, which do not require the player to curve the ball into the goal.

Currently, there is a need for a soccer training device that provides an easy to use mechanism for teaching player kicking the ball into the goal and one defending the goal to position themselves properly. In addition, there is currently a need for a soccer training device to teach a player how to spin the soccer ball to curve it into the goal.

SUMMARY OF THE INVENTION

One embodiment of the present invention is A soccer trainer [1000] for teaching a player to properly kick a soccer ball on a field between a left goal post [11] and a right goal post [13] and beneath the crossbar [15 of a soccer goal [10] comprising:

a) a kick pad [1100] for protecting said field and for identifying where to place said soccer ball;

b) at least two lengths of guideline [1370] having a first end and a second end where the first end of each connects to each of said goal posts [13,15];

c) a base mechanism [1300] connected to the kick pad [1100] having a left and a right side, one end of guideline [1370] extending from the left side of the base mechanism [1300] and attaching to said left goal post [11], the second end of guideline [1370] extending from the right side of the base mechanism [1300] and attaching to the right goal post [13] to define a maximum angle for kicking said soccer ball into said goal [10].

The invention may also be embodied as a soccer trainer [1000] for teaching a player to properly kick a soccer ball on a field between a left goal post [11] and a right goal post [13] and beneath the crossbar [15] of a soccer goal [10] comprising:

a) a kick pad [1100] for protecting said field and for identifying where to place said soccer ball;

b) a first guideline [1371] connected to left goalpost [11], c) a second guideline [1373] connected to the right goal post [13];

d) a base mechanism [1300] connected to the kick pad [1100] having a left and a right side, the base mechanism comprising:

a first reel [2351] housed in the left side of the base mechanism adapted to retract and store the first guideline [1371], a second reel [2353] housed in the right side of the base mechanism adapted to retract and store the second guideline [1373] to define a maximum angle for kicking said soccer ball between the left goal post [11] and the right goal post [13].

The invention may also be embodied as a method of training a player to correctly kick a soccer ball into a goal [10] having a left and right side, comprising the steps of:

a) providing a kick pad [1100] having a right side and a left side, for holding said soccer ball intended to be kicked;

b) providing a retractable guideline [1371] from the left side of the kick pad [1100] to the left side of the goal [10], c) providing a retractable guideline [1373] from the right side of the kick pad [1100] to the right side of the goal, thereby defining a region between the guidelines [1371, 1373] in which to kick the soccer ball;

d) kicking the soccer ball between the guidelines [1371, 1373} to score a goal; and e) retracting each of the guidelines [1371, 1373] after use for storage.

OBJECTS OF THE INVENTION

It is an object of the present invention to provide a soccer training device which enables a soccer player to improve his/her positional awareness in relation to the goal and/or the player kicking the soccer ball.

It is another object of the present invention to provide a soccer training device which enables soccer players to improve their aim for shots on goal.

It is another object of the present invention to provide a soccer training device which enables soccer players to learn to apply spin to curve shots around players.

It is another object of the present invention to provide a soccer training device which is easy to assemble, disassemble, and store.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
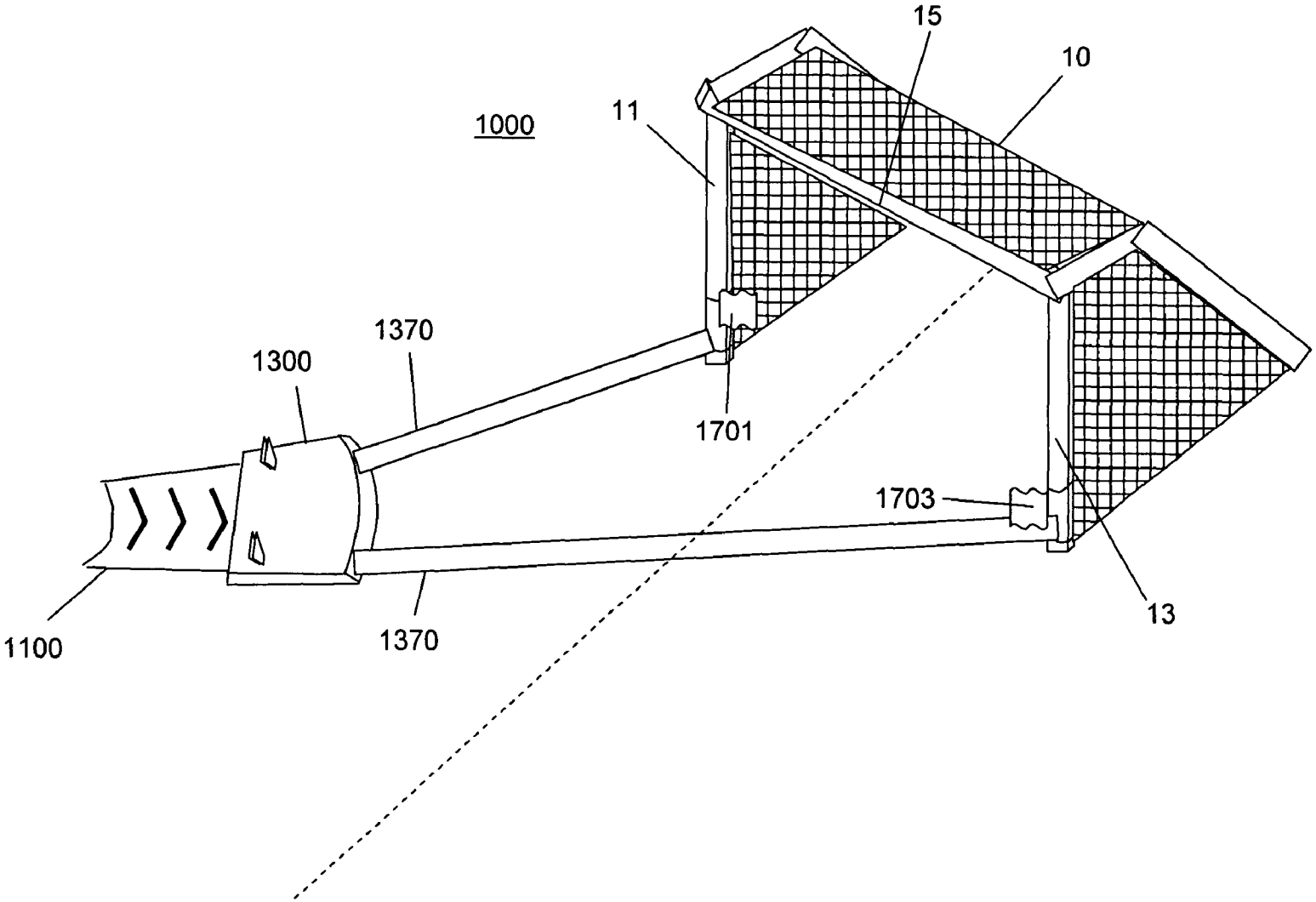
FIG. 1 is an overall perspective view of one embodiment of the soccer trainer according to the present invention.

FIG. 1 is an overall perspective view of one embodiment of the soccer trainer 1000 according to the present invention.

In this view a soccer goal 10 having goal posts 11 and a cross bar 13 is shown. The soccer trainer employs a flexible kick pad 1100 which is placed on the ground a distance from the goal 10.

A base mechanism 1300 has a rigid housing which attaches to the kick pad 1100. Base mechanism 1300 is designed to be anchored in place to restrict its movement.

A base guideline 1370 extends from the base mechanism 1300 toward each of the goal posts 11. The base guideline 1370 which is tape or rope, which is preferably ¼" wide that has markings along its length to identify feet, yards and/or meters.

Base mechanism 1300 encloses a spool (1350 of FIGS. 4-5) which stores the base guideline 1370 when not in use. The spool may be spring-loaded or reeled by a manual crank.

Figure 2:
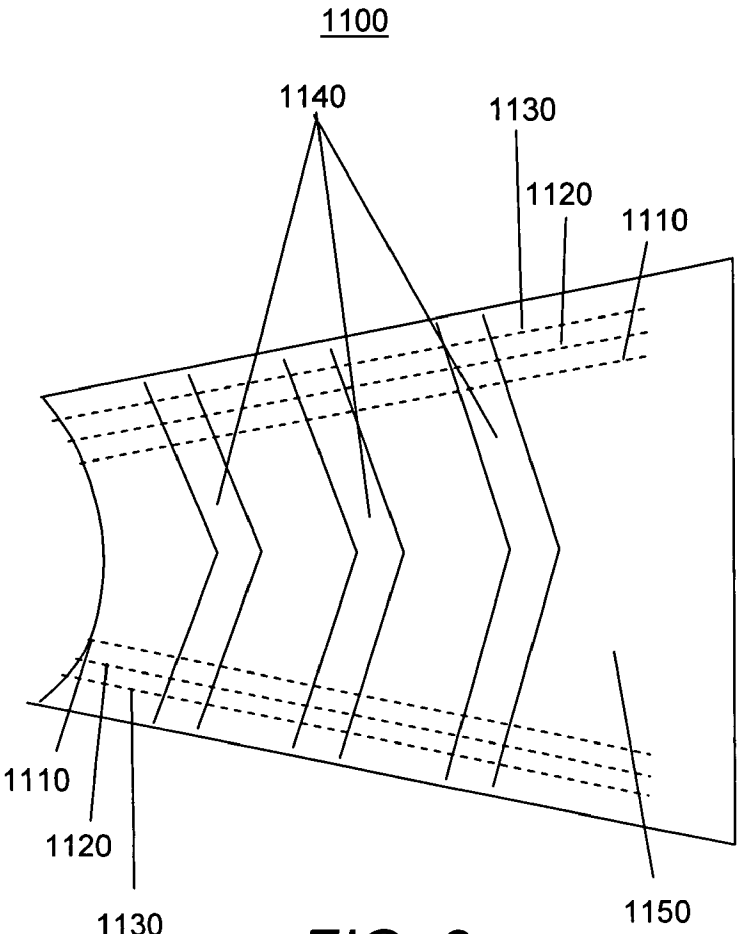
FIG. 2 is an enlarged view of the kick pad portion of the embodiment of FIG. 1.

FIG. 2 is an enlarged view of the kick pad 1100 of the embodiment of FIG. 1. The kick pad 1100 has several lines showing a proposed path of the soccer ball to which will hit the furthest extent inside the left or right of the goal when positioned a fixed distance from the goal 10. There are several lines based upon the size of the soccer ball being used. For example, a set of lines 1110 for a size 3 soccer ball, another set of lines 1120 for a size 4 soccer ball and another set of lines 1130 for a size 5 soccer ball. These lines may be color coded for children to use.

Kick pad 1100 may also employ arrows 1140 indicating the direction in which to kick the soccer ball. The direction arrows 1140 may be made of a rough non-slip material. They may also be slightly raised for traction.

The kick pad 1100 is preferably approximately 18 inches long and 13 inches wide at its widest point. It has angled sides. It also has one end 1150 which is shaped to mate with the base mechanism 1300.

Figure 3:
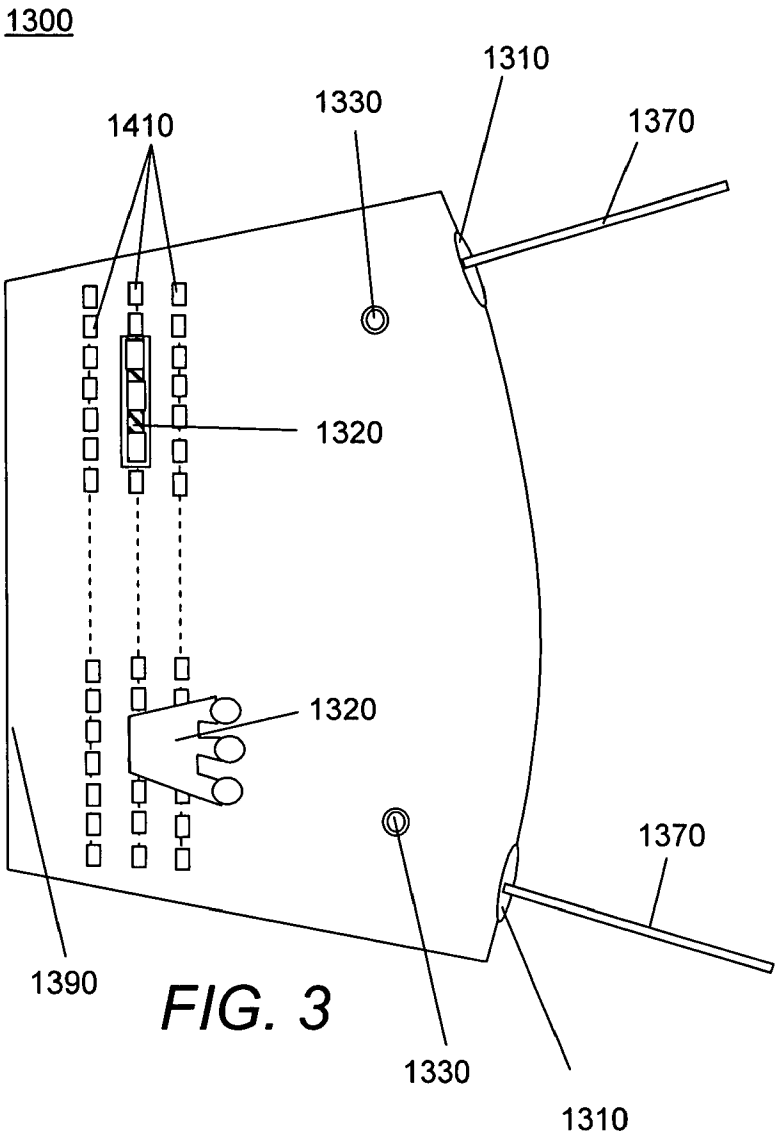
FIG. 3 is an enlarged view of one embodiment of the base mechanism of the embodiment of FIG. 1.

FIG. 3 is an enlarged view of one embodiment of the base mechanism (1300 of FIG. 1). It is made of a rigid material such as a hard plastic. It has a low profile with a smooth surface allowing a soccer ball to easily pass over it when kicked.

It has a mating end 1390 which attaches to the mating end 1150 of the kick pad 1100.

Base mechanism 1300 includes the spool (1350 of FIGS. 4 and 5) which holds and provides a length of base guideline 1370. Base guideline 1370 extends out of exit holes 1310 in base mechanism 1300.

Base guidelines 1370 extend until they attach to the retractable guidelines 1510 from the retraction devices 1500.

The base mechanism 1300 has a plurality of anchor holes 1330.

At least one simulated blocker 1320 is supplied. This is a barrier which simulates players on the field trying to block the kick of a player. It is sized and positioned to approximate a normal sized player at various distances. For example, the minimum distance that a player can stand from a player kicking a free kick is 10 yards for 10 year old soccer player. The average height of a 10 year old player is 5'. The simulated blockers 1320 are 2.5" high. If the simulated blocker 1320 is placed at a distance from the ball of 15", it is equivalent to a 5' blocker standing 10 yards from the player.

The simulated blockers 1320 may be a pop-up type or may be removable and can be inserted into a number of different attachment points 1410 at different locations.

If the simulated blocker 1320 is moved to a location 12.5" from the ball, it approximates a 6' blocker 10 yards away.

If one were to place the soccer trainer 1000 twenty yards from the goal and place the simulated blocker 1320 at a location 18.75" from the ball, and kick over the simulated blocker the trajectory of the ball will be just below the cross bar of the goal, approximately 8" high.

Therefore, the position of the simulated blockers 1320 may be moved to simulate players of different sizes and/or locations.

Also, one may kick the ball between the simulated blockers 1320 into the goal 10. This provides practice on shooting between players.

There is a more advanced type of kick which allows a player to spin the ball and make it curve around objects. This is especially important when there is no straight line from the starting point to the desired target location. Practicing this type of kick is difficult, especially since it is difficult to measure when one is improving.

Furthermore, when in use, the soccer trainer 1000 instructs the goalie as to the appropriate position from which to best defend the goal 10. In particular, the goalie can learn to defend the goal from players who kick the soccer ball to the goal from acute (lateral) angles and/or defend the goal against a curved trajectory of the soccer ball.

One may practice by placing the simulated blockers 1320 at a location which blocks a straight line shot to a target, such as the right target flag (1703 of FIG. 1). The player then kicks and spins the ball so that it curves around the simulated blocker 1320 and hits the target flag (1703 of FIG. 1).

Once this is accomplished, the player may move the simulated blocker 1320 more toward the left into another location. The same exercise is performed. A greater curve is now required to hit the target flag (1703 of FIG. 1). One can now quantify the amount of curve based upon the distance from the goal and the position of the simulated blocker 1320.

Figure 4:
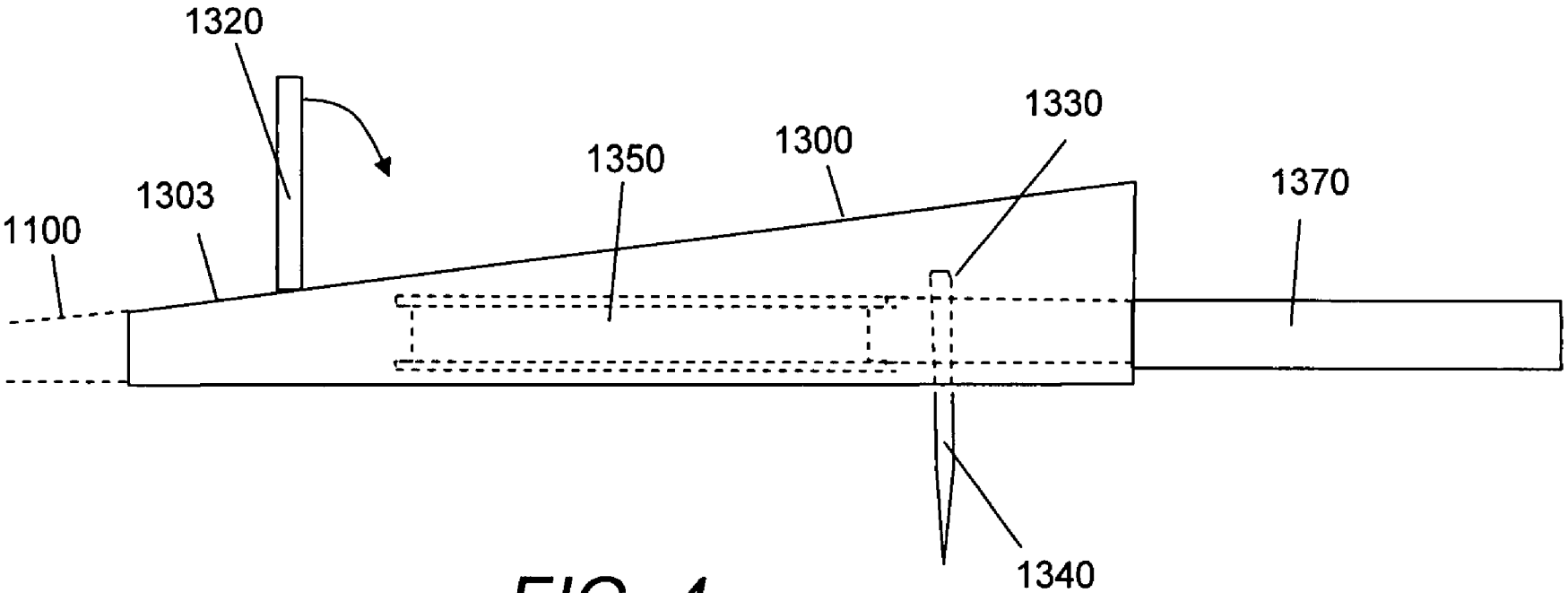
FIG. 4 is an enlarged side elevational view of one embodiment of the base mechanism of FIG. 1.

FIG. 4 is a side elevational view of one embodiment of the base mechanism 1300 of the embodiment of FIG. 1.

In this figure the simulated blocker 1320 is shown attached to the base housing 1303.

At least one stud 1340 passes through the anchor holes 1330 and into the ground to secure the base mechanism 1300 in place.

The spool 1350 is shown with the base guideline 1370 extending from it.

The spool 1350 may also employ a spring mechanism 1357 which will act to draw in the guideline 1370 for storage.

Figure 5:
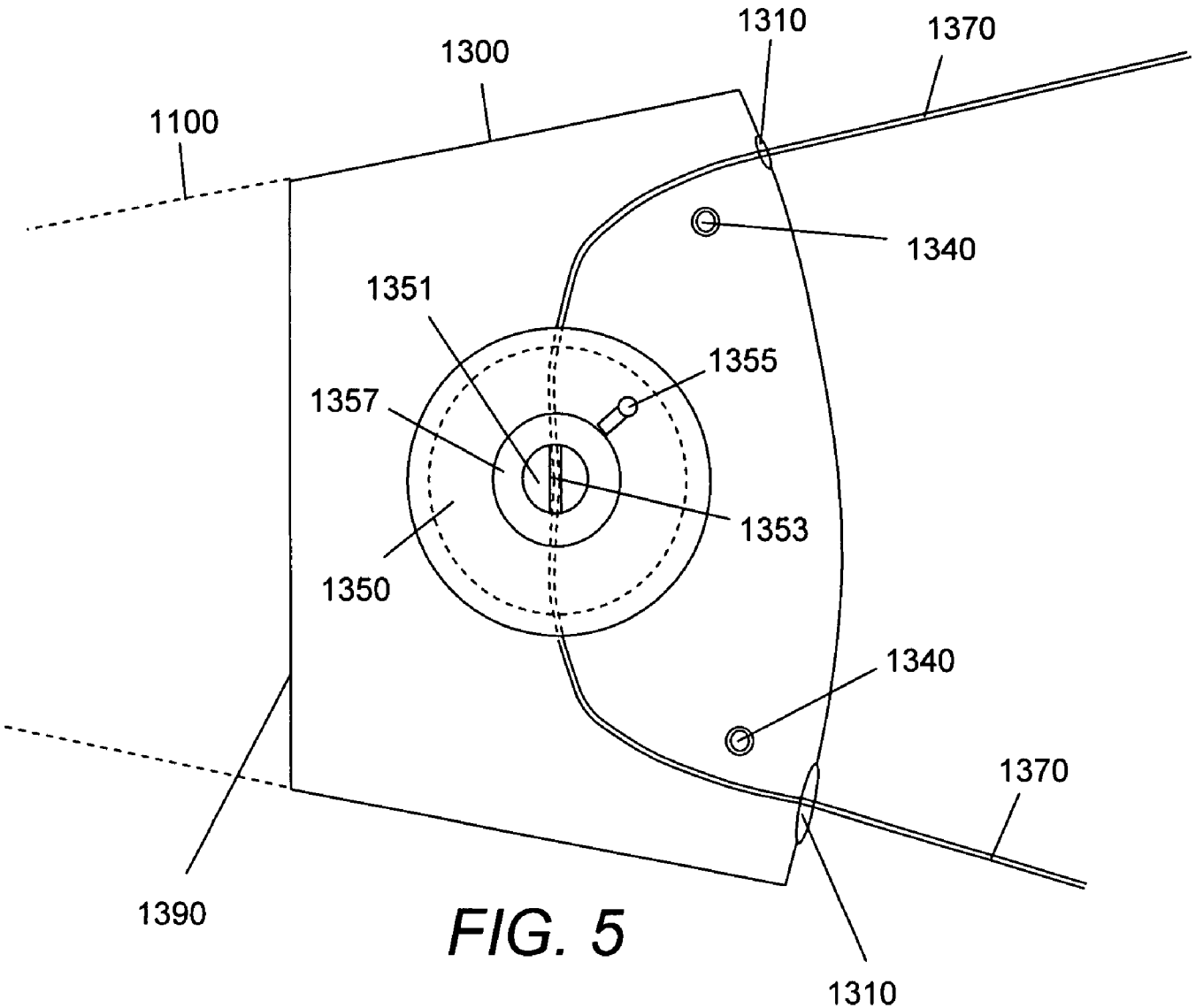
FIG. 5 is an enlarged plan view from the bottom of one embodiment of the base mechanism of FIG. 1 with the base cover removed.

FIG. 5 is a plan view from the bottom of one embodiment of the base mechanism (1300 of FIG. 1) with the base cover removed.

Here spool 1350 is shown having a core 1351 around which base guideline 1370 is wrapped. In this embodiment, a crank arm 1355 is manually rotated causing base guideline to be pulled into the base mechanism 1300 and wrapped around the core 1351.

When fully extended, base guideline 1370 is allowed to freely pass through core hole 1353. This allows more or less of the base guideline 1370 to extend from either side.

Studs 1340 are shown here extending out of the plane of the page.

Figure 6:
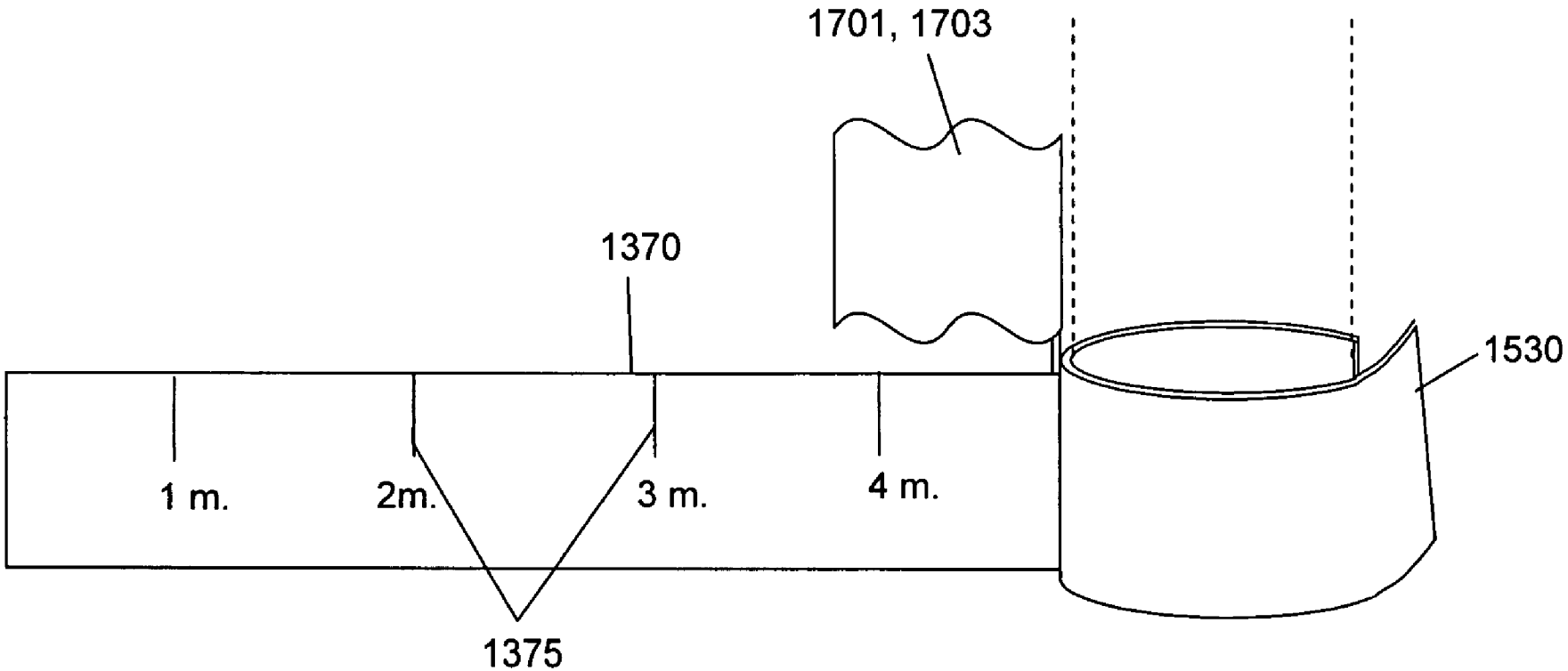
FIG. 6 is an illustration of the ends of the guidelines of the embodiment shown in FIG. 1.

FIG. 6 is an illustration of the ends of the guidelines of the embodiment shown in FIG. 1.

Here guideline 1371, 1373 is shown partially extended. It has markings 1375 indicating the length of guideline extended. Here the markings are in terms of meters. They may be any unit of measurement including yards, feet or any combinations of these.

The end of guideline 1371, 1373 has a connecting strap 1513, 1533 which removeably connects the guideline to one of the goal posts 11, 13. These may be hook-and-loop connectors similar to the product Velcro®. Any other known removeable attachment device may be used, such as snaps, clips and belts.

It also shows target flags 1701, 1703 located near each goal post 11, 13 when in use.

Figure 7:
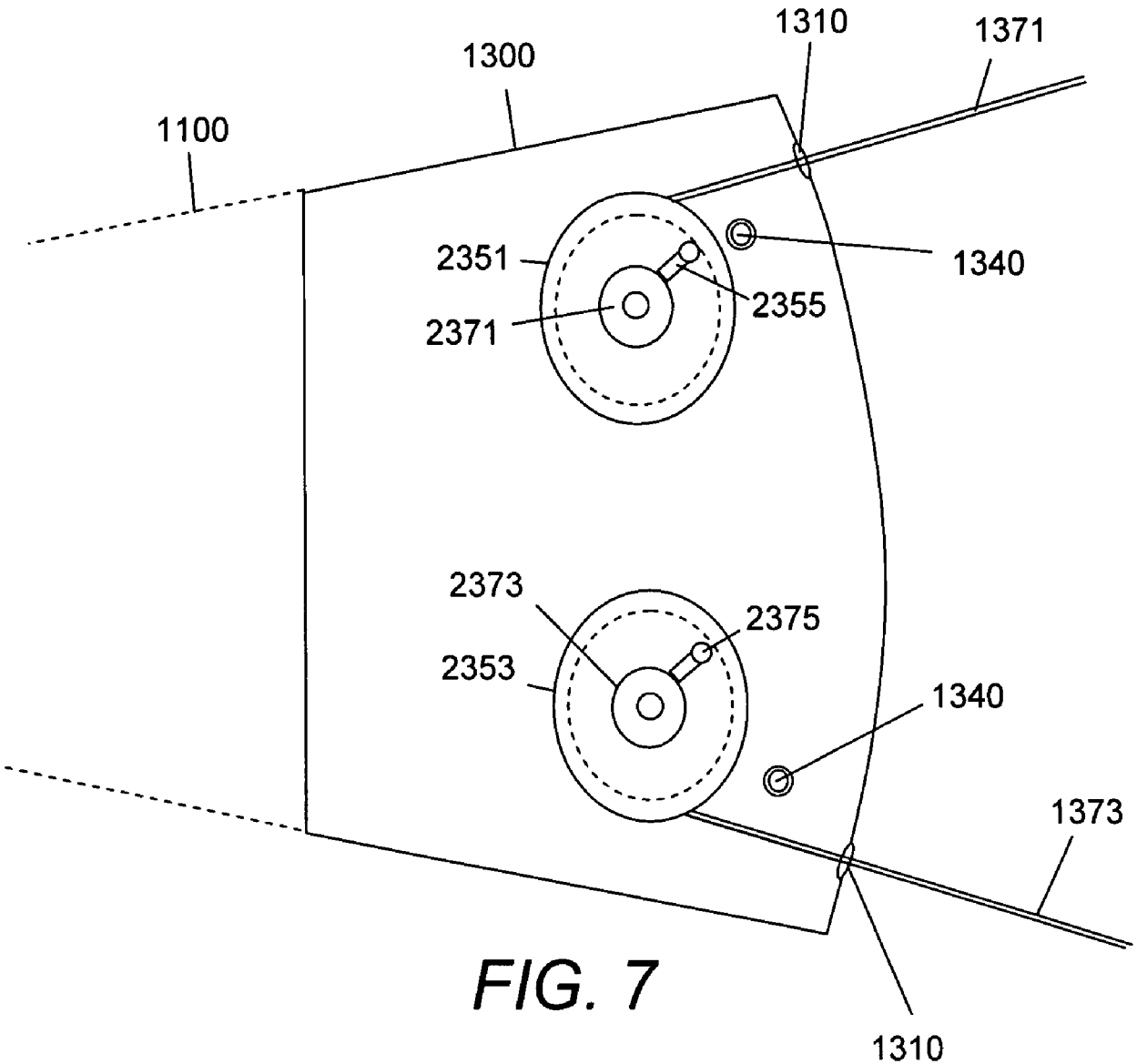
FIG. 7 is a plan view of a second embodiment of the base mechanism according to the present invention shown with the base cover removed.

FIG. 7 is a plan view of a second embodiment of the base mechanism 1300 according to the present invention shown with a base cover removed. The substantially flat base cover (not shown) covers the bottom of the base mechanism 1300.

Here, the guideline 1370 is actually two guidelines 1371, 1373. Each connects to a separate reel 2351, 2353. When not in use, each guideline 1371, 1373 are reeled into and stored on reels 2351, 2353 respectively.

Spring mechanisms 2371 and 2373 may be employed which are tensioned when the guidelines 1371, 1373 are extended. The spring mechanisms 2371, 2373 then aid in reeling in guidelines 1371, 1373 when the soccer trainer is intended to be disassembled and stored.

Figure 8:
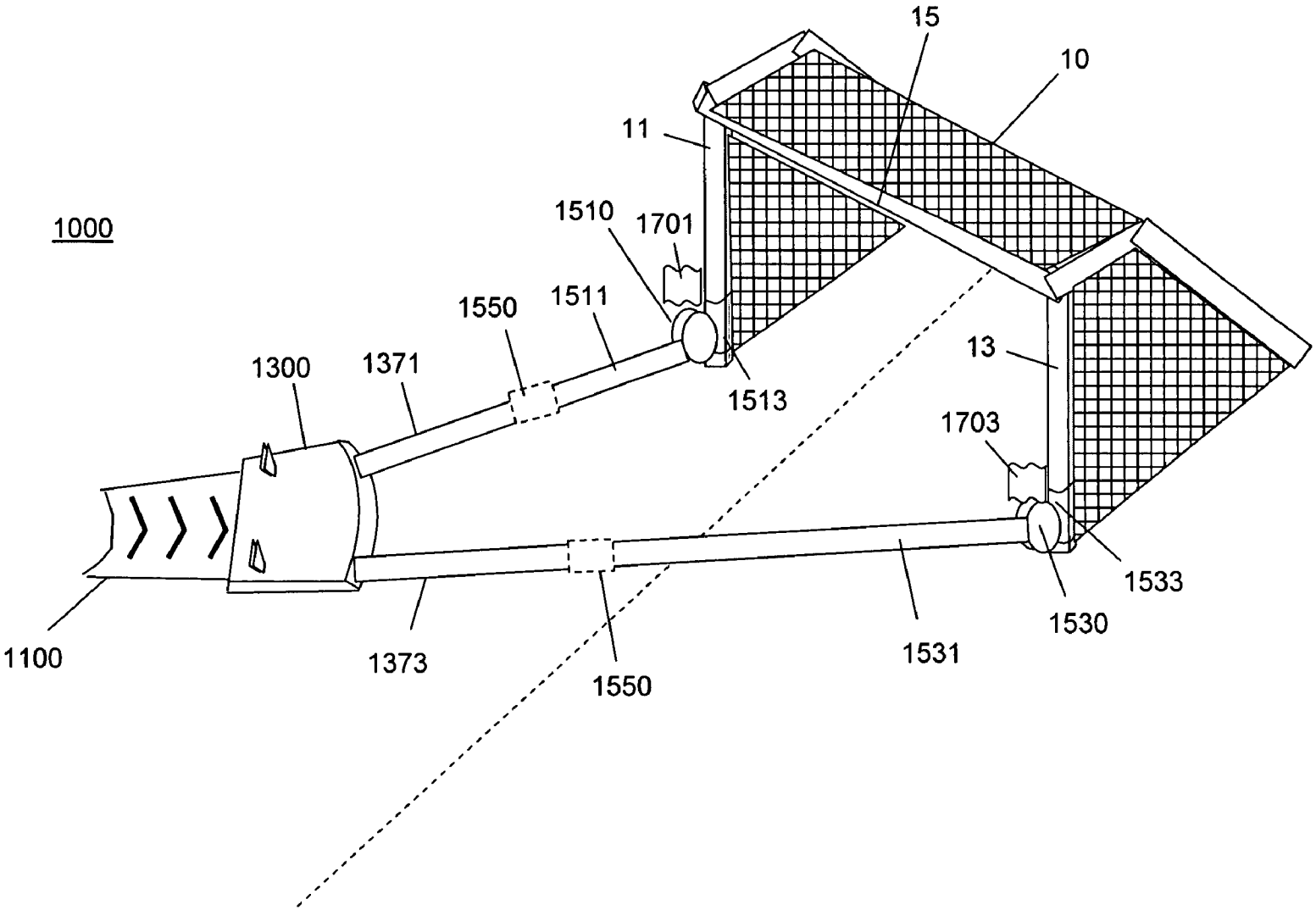
FIG. 8 is an overall perspective view of another embodiment of the soccer trainer according to the present invention.

FIG. 8 is an overall perspective view of another embodiment of the soccer trainer according to the present invention.

This is similar to the embodiment shown in FIG. 1. The embodiment of FIG. 8 employs two separate guidelines 1371, 1373. Also, the spool 1350 in the base mechanism 1300 of FIG. 1 is replaced by a pair of retraction devices 1510, 1530 located at the left goal post 11 and the right goal post 13.

In an alternative embodiment of the invention both retractor devices 1500 and internal spools 2351, 2353, or reel 1350 may be used together. In this case, guidelines 1371, 1373 connect with guidelines 1511, 1531, respectively at connectors 1550.

Figure 9:
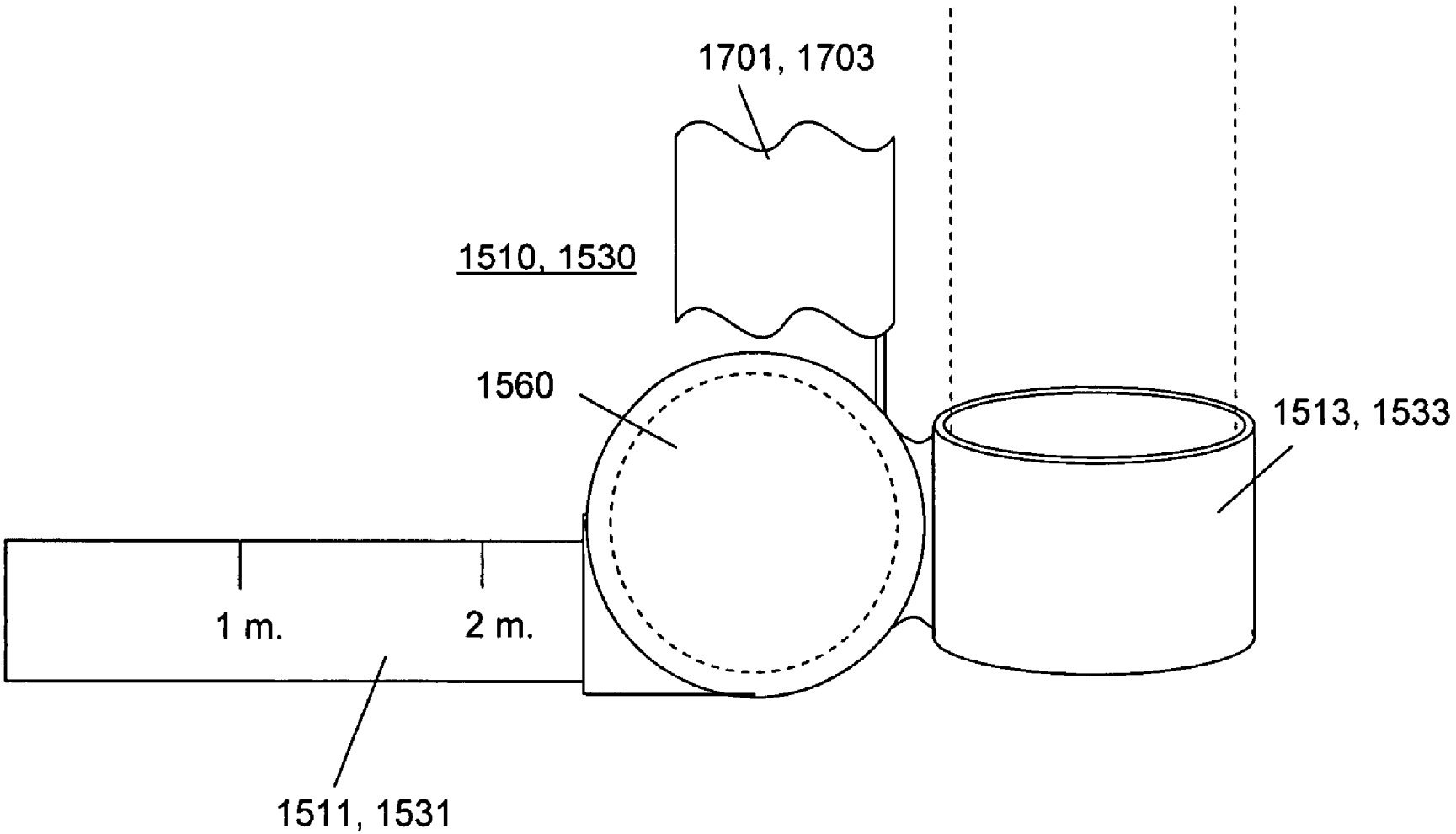
FIG. 9 is an enlarged side elevational view of another embodiment of the retraction device 1500 of FIG. 1.

FIG. 9 is an enlarged side elevational view of another embodiment of the retraction device 1500 of FIG. 1.

Retraction device 1510, 1530 employs a retraction spool 1560 which may be spring loaded, or may be manually operated. It functions in a similar manner to that of spool 1350 of the base mechanism 1300.

Retraction spool 1560 is allowed to retract and store, or extend the retractable guidelines 1511, 1531.

Retraction device 1510, 1530 has a connector strap 1513, 1533 which is used to attach retraction device 1510, 1530 to the goal post 11, 13.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A soccer trainer [1000] for teaching a player to properly kick a soccer ball on a field between a left goal post [11] and a right goal post [13] and beneath the crossbar [15 of a soccer goal [10] comprising:

a) a kick pad [1100] for protecting said field and for identifying where to place said soccer ball;

b) at least two lengths of guideline [1370] having a first end and a second end where the first end of each connects to each of said goal posts [13,15];

c) a base mechanism [1300] connected to the kick pad [1100] having a left and a right side, one end of guideline [1370] extending from the left side of the base mechanism [1300] and attaching to said left goal post [11], the second end of guideline [1370] extending from the right side of the base mechanism [1300] and attaching to the right goal post [13] to define a maximum angle for kicking said soccer ball into said goal [10].

2. The soccer trainer [1000] of claim 1 wherein the mechanical base [1300] further comprises:

a spool [1350] for winding up and storing a portion of the guideline [1370].

3. The soccer trainer [1000] of claim 2 further comprising on the spool [1350]:

a crank arm [1355] which causes spool [1350] to reel in guideline [1370] when manually reeled.

4. The soccer trainer [1000] of claim 2 further comprising:

a spring mechanism [1357] on spool [1350] causing the spool [1350] to automatically retract the guideline [1370] for storage.

5. The soccer trainer [1000] of claim 1 wherein the spool [1350] has a core [1351] with a core hole [1353] through which the guideline [1370] slides to extend either end of guideline [1370].

6. The soccer trainer [1000] of claim 1 further comprising:

at least one target flag [1540] allowing said player to kick said ball at the flag.

7. The soccer trainer [1000] of claim 1 further comprising:

simulated blockers [1320] used to block said soccer ball having a height and position to simulate full players at a distance.

8. The soccer trainer [1000] of claim 1 wherein the base mechanism [1300] has a plurality of attachment points [1330] at varying distances and sideways displacements on the base mechanism [1300] for holding the simulated blockers [1320].

9. The soccer trainer [1000] of claim 1 further comprising:

simulated blockers [1320] blocking a straight line to a target in said goal [10] causing said player to curve said ball around the simulated blocker [1320] to hit the target.

10. The soccer trainer of claim 1 further comprising:

a) a second guideline [1511] attached to the first end [1371] of guideline [1370];

b) a third guideline [1531] attached to the second end [1373] of guideline [1370];

c) a first retraction device [1510] attached to said left goal post [11], adapted to retract in the second guideline [1511] in for storage; and d) a second retraction device [1530] attached to said right goal post [13], adapted to retract in the third guideline [1531] in for storage.

11. A soccer trainer [1000] for teaching a player to properly kick a soccer ball on a field between a left goal post [11] and a right goal post [13] and beneath the crossbar [15] of a soccer goal [10] comprising:

a) a kick pad [1100] for protecting said field and for identifying where to place said soccer ball;

b) a first guideline [1371] connected to left goalpost [11], c) a second guideline [1373] connected to the right goal post [13];

d) a base mechanism [1300] connected to the kick pad [1100] having a left and a right side, the base mechanism comprising:

a first reel [2351] housed in the left side of the base mechanism adapted to retract and store the first guideline [1371], a second reel [2353] housed in the right side of the base mechanism adapted to retract and store the second guideline [1373] to define a maximum angle for kicking said soccer ball between the left goal post [11] and the right goal post [13].

12. The soccer trainer [1000] of claim 11 further comprising on the reels [2351, 2353]:

crank arms [2353, 2355] respectively, which cause reels [2351, 2353] to reel in guidelines [1371, 1373] when manually reeled.

13. The soccer trainer [1000] of claim 11 further comprising:

a spring mechanism on each reel [2351, 2353] causing the reels to automatically retract the guidelines [1371, 1373] for storage.

14. A method of training a player to correctly kick a soccer ball into a goal [10] having a left and right side, comprising the steps of:

a) providing a kick pad [1100] having a right side and a left side, for holding said soccer ball intended to be kicked;

b) providing a retractable guideline [1371] from the left side of the kick pad [1100] to the left side of the goal [10], c) providing a retractable guideline [1373] from the right side of the kick pad [1100] to the right side of the goal, thereby defining a region between the guidelines [1371, 1373] in which to kick the soccer ball;

d) kicking the soccer ball between the guidelines [1371, 1373} to score a goal; and e) retracting each of the guidelines [1371, 1373] after use for storage.

15. The method of training of claim 14, further comprising the step of:

providing a target flag [1701, 1703] in said goal [10] to act as a target.

16. The method of training of claim 14, further comprising the step of:

providing simulated players [1320] between the kick pad [1100] and the goal [10] to be used as obstacles when kicking said soccer ball into the goal [10].

17. The method of training of claim 14, further comprising the step of:

providing simulated players [1320] between the kick pad [1100] and the goal [10] positioned to block a straight line to a target into the goal requiring said soccer ball to be kicked in a curved path to hit the target [1701, 1703].

* * * * *